United States Patent [19]

Linn

[11] 4,071,982

[45] Feb. 7, 1978

[54] METHOD AND IMPLEMENT FOR CLEANING SPRING-CONTACTS OF A TUNER

[76] Inventor: Marvin Linn, 150 Marine Ave., Brooklyn, N.Y. 11209

[21] Appl. No.: 755,024

[22] Filed: Dec. 28, 1976

[51] Int. Cl.[2] ..... B24B 19/00; B24B 1/00; H03J 5/00

[52] U.S. Cl. ..... 51/241 S; 51/281 R; 134/7; 334/47

[58] Field of Search ..... 51/16, 22, 394, 401, 51/406, 407, 204, 241 R, 241 S, 281 R, 328; 134/6, 42, 7; 334/50, 47, 89

[56] References Cited

U.S. PATENT DOCUMENTS

| | | | |
|---|---|---|---|
| 2,750,479 | 6/1956 | Guboff | 334/47 |
| 3,590,537 | 7/1971 | Hennig | 51/241 S |
| 3,613,149 | 10/1971 | Gurkin | 334/89 |
| 3,613,318 | 10/1971 | Gianatasio | 51/394 X |
| 3,729,768 | 5/1973 | Gurkin | 334/50 |
| 3,916,357 | 10/1975 | Jones | 334/50 X |

*Primary Examiner*—Harold D. Whitehead
*Assistant Examiner*—Nicholas P. Godici
*Attorney, Agent, or Firm*—Wender, Murase & White

[57] ABSTRACT

A method for cleaning the fixed spring-contacts of a cylindrical, drum-type television tuner or other electrical switch having contact-carrying strips arranged around the circumference of a rotatable drum, in which a cleaning implement is attached to the drum and is rotated into engagement with the fixed contacts so as to clean the same. The implement includes a support for attachment to the drum and a cleaning element on the support for engaging and cleaning the spring-contacts of the switch upon rotation of the drum. The cleaning element may be a set of eraser pads, an elongated eraser strip, or a coating or layer of abrasive material; and the support element may be made for the attachment to the drum either in superposition with an operative contact-carrying strip or in lieu thereof.

4 Claims, 6 Drawing Figures

Fig. 1
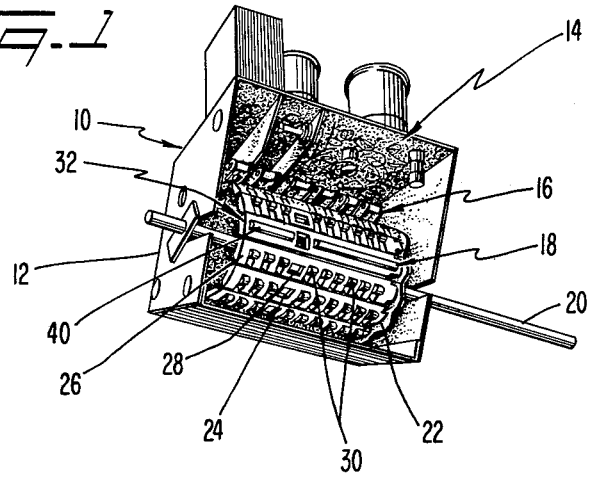
Fig. 2
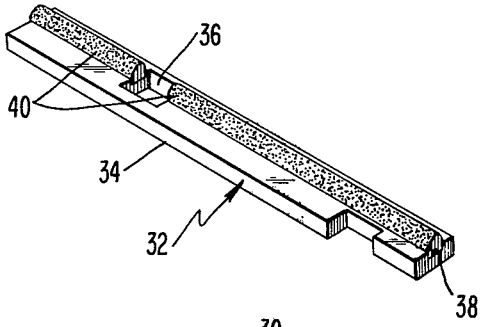
Fig. 3
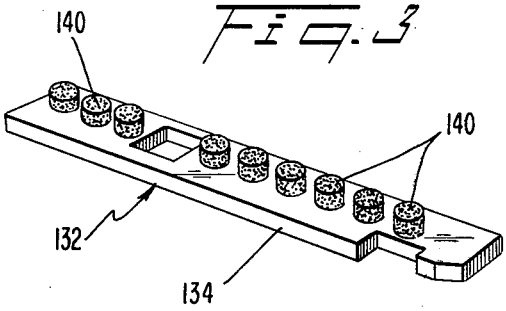
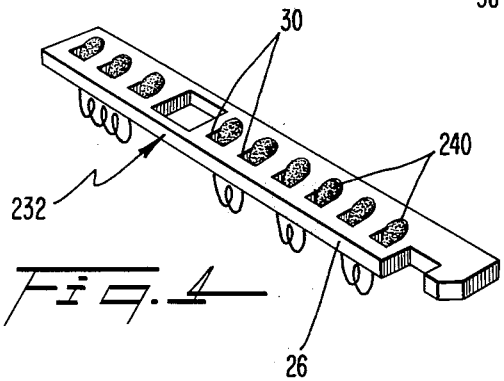
Fig. 4
Fig. 5
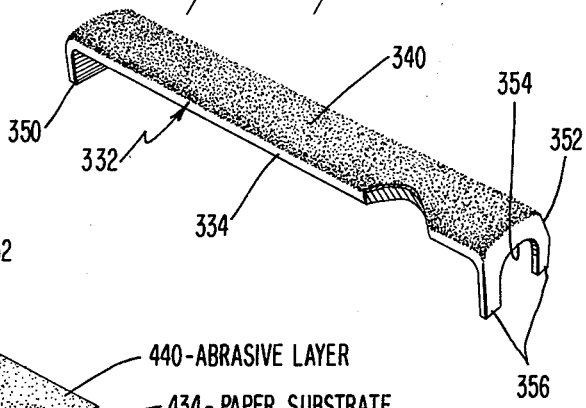
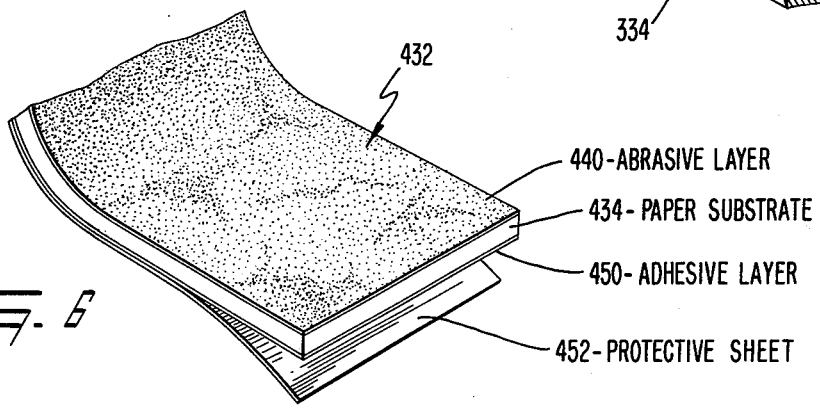
Fig. 6

METHOD AND IMPLEMENT FOR CLEANING SPRING-CONTACTS OF A TUNER

BACKGROUND OF THE INVENTION

1. Field of the Invention

The present invention relates generally to cleaning implements and methods, and more particularly, to a method and implement for cleaning the fixed spring-contacts of a television tuner.

2. Description of the Prior Art

Multiple position television tuners generally fall into two categories, namely, wafer tuners and drum tuners. Tuners of the latter type include a set of fixed, spring-contacts which are selectively engaged by one of a series of channel selector strips arranged about the circumference of a rotatable drum. The channel selector strips carry a set of electrical contacts to which a series of coils are attached. Upon rotation of the drum, one of the coil-carrying channel selector strips is brought into engagement with the fixed, spring-contacts whereupon the coils are placed in the frequency determining circuit of the tuner so as to condition the television receiver to receive signals on a desired channel.

The channel selector strips usually contain eight contacts, and the drum assembly generally contains thirteen such strips about its circumference. Thus, the drum typically includes some 104 contacts which will selectively be brought into engagement with eight, fixed spring-contacts on each full rotation of the tuner shaft. After the tuner has been in use for a period of time, a film of dirt and other contaminants collects on all of the contacts thereby interferring with proper circuit connections which are necessary to optimum tuner performance. When this contaminant layer begins to build up to the point where it interferes with the switching function of the tuner, the tuner becomes "noisy" in that flickering and "snowy" pictures occur as well as poor audio whenever the tuner shaft is moved from one channel to the next. The dirt and contamination can also build up to the point where certain channels cannot be received at all.

When a television tuner of the drum-type has become coated with the dirt and contaminant film mentioned above, it is necessary to clean all of the contacts in order to restore proper tuner performance. In the past, the tuner contacts have been cleaned using a solvent wash which will remove most of the contaminant particles but is ineffective in removing some of the more dense films and dirt layers. To remove this material, a fine abrasive sandpaper or eraser can be used. The contacts of the channel selector strip of the drum can be easily cleaned using this technique, but it is often difficult or impossible to reach the fixed, spring-contacts of the tuner without removing several of the channel selector strips from the drum. This involves a considerable amount of time and effort, and there is also the possibility of inadvertently damaging the individual strips on removal or reinsertion as well as the possibility of replacing the strips in the wrong position.

As a result of the above problems, periodic cleaning and overhaul of television tuners is generally expensive, time-consuming, and presents considerable difficulties even to experienced repairmen.

SUMMARY OF THE INVENTION

It is therefore an object of the present invention to facilitate the cleaning of fixed, spring-contacts of a television tuner without requiring disassembly or removal of the tuner from the television receiver.

This invention has a further object in the cleaning of fixed, spring-contacts of a tuner by attaching a cleaning implement to the tuner drum, and thereafter rotating the drum so as to bring the cleaning implement into engagement with the fixed, spring-contacts.

The cleaning implement according to the present invention is summarized as including a support for attachment to the drum and a cleaning element on the support for engaging and cleaning the spring-contacts of the tuner upon rotation of the drum.

The method according to the present invention includes the steps of attaching a cleaning element to the tuner drum, and rotating the drum to bring the cleaning element into engagement with the spring-contacts of the tuner so as to clean the fixed contacts.

This invention provides a number of distinct advantages over the prior art in that the fixed, spring-contacts of a tuner may be completely cleaned without major disassembly of the tuner, and that the cleaning operation can be carried out simply, economically, and with minimal chance of damage to the tuner.

Other objects and advantages of the present invention will become apparent from the following description of the preferred embodiments when taken in conjunction with the accompanying drawing.

BRIEF DESCRIPTION OF THE DRAWING

FIG. 1 is a perspective view of a drum-type tuner including a preferred embodiment of a cleaning implement according to the present invention;

FIG. 2 is a perspective view of the cleaning implement of FIG. 1;

FIG. 3 is a perspective view of a modification of the cleaning implement of FIG. 2;

FIG. 4 is a perspective view of another embodiment of a cleaning implement according to the present invention;

FIG. 5 is a perspective view of a further embodiment of a cleaning implement according to the present invention; and FIG. 6 is a partial perspective view of yet another embodiment of a cleaning implement according to the present invention.

DESCRIPTION OF THE PREFERRED EMBODIMENTS

The present invention is adapted to be utilized in connection with drum-type television tuners or other electrical switches such as the conventional tuner 10 depicted in FIG. 1. The tuner 10 has a housing 12 which supports electrical circuitry 14 as well as a set of fixed, spring-contacts 16. A drum assembly 18 includes a shaft 20 journalled for rotation in housing 12 and including an end wall disc 22 and an intermediate disc having a series of radially spaced protruding support pins 24.

A series of elongated, contact-carrying, channel selector strips 26 is mounted about the circumference of drum assembly 18, as shown. Each of the strips 26 includes an opening 28 for cooperation with a protruding pin 24 of the intermediate disc, and is captured between the protruding pin 24 and end wall 22 of the drum. Such strip can be removed and replaced if necessary. A series of frequency determining coils (not shown) are disposed on the inner side of each of the strips 26 and are connected to a series of contacts 30 arranged in a line parallel to the axis of shaft 20.

In normal operation, a detent assembly (not shown) cooperates with the drum 18 so that the drum may be rotated to any of thirteen positions at which the contacts 30 of a selected one of thirteen channel selecting strips 26 is brought into registration with the fixed, spring-contacts 16. The coils of that strip thereby are placed in circuit so that the desired channel can be received.

Referring to FIGS. 1 and 2, a preferred embodiment of a cleaning implement 32 according to the present invention is illustrated and includes a support element or base 34 which is shaped similarly to a channel selector strip 26. The support element 34 is an elongated, generally rectangular member which may be constructed from any number of materials, such as plastic, aluminum, hard rubber, etc. Support element 34 has an opening 36 for cooperation with one of the protruding pins 24 of the tuner drum so that the implement 32 can be mounted on the drum in place of a channel selector strip 26, preferably corresponding to an unused channel.

A longitudinal channel or groove 38 runs down the entire length of the outer surface of support element 34 for receiving one or more abrasive cleaning strips 40. The abrasive strips 40 may be made of any suitable material, but preferably consist of thin eraser rods having a diameter slightly larger than the width of channel 38 so as to be retained firmly therein while protruding slightly above the plane of the upper surface of support 34. Depending upon the necessary position of hole 36, determined by the original tuner design for which the cleaning element is to be used, the eraser 40 may be a single eraser rod or may be two spaced rods, as shown in FIG. 2.

In operation, whenever it is desired to clean the fixed, spring-contacts of a tuner, one of the channel selecting strips 26 is first removed, and the cleaning implement 32 mounted in its place, as shown in FIG. 1. In this position, the top surface of the abrasive eraser 40 will be in approximately the same position as the contacts 30 of the removed strip 26. The drum shaft 20 is then rotated so as to bring the cleaning implement 32 around to the position of the spring-contact assembly 16. Continued rotation of the shaft 20 back and forth causes the eraser 40 to wipe the spring-contacts clean whereupon the contaminant film is completely removed without causing any damage to the tuner assembly.

After the above-described operation is complete, the tuner drum is then rotated so as to expose the cleaning implement 32 whereupon it may be removed and the channel selector strip 26 replaced. Once the contacts of the channel selector strips are cleaned, using conventional techniques, the entire tuner switching assembly will be ready for subsequent use. In this manner, the tuner can be quickly and effectively cleaned without damage and without requiring removal of several channel selector strips.

A modification of the cleaning implement 32 of FIG. 2 is shown in FIG. 3. The cleaning implement 132 of FIG. 3 includes a support element 134 on which are mounted a series of abrasive pads or discs 140 which may be made of any suitable material. Preferably, abrasive discs or pads 140 are constructed of erasers which are attached, as by adhesives or by press fitting individual pads into blind bores to the top surface of support element 134. The abrasive pads are mounted on support 134 at spaced locations corresponding to the axial positions of the fixed spring-contacts of the tuner so that when the cleaning implement is attached to the drum, the individual pads will each engage and clean a corresponding spring-contact.

Another embodiment of a cleaning implement according to the present invention is illustrated in FIG. 4. The implement, identified by the number 232, consists of a conventional channel selector strip 26 which has been modified by applying a coating of abrasive material 240 to each of the contacts 30. A channel selector strip 26 taken from a discarded tuner can be used for this purpose, and a series of strips taken from different ones of the popular tuners can be packaged for field use by a repairman. Coating 240 may be of any suitable type, and preferably consists of a painted layer of abrasive particles suspended in a hardenable binder. Any number of abrasives in powdered or ground form may be used, such as sand, pumice, metal powder, etc. The binder need not be of any special type, and, for example, may consist of a highly volatile cement in which the abrasive is suspended. Preferably, the abrasive, volatile-cement mixture is rapid drying so that the contacts may be painted with one or more layers just prior to use.

The cleaning implement 232 of the embodiment of FIG. 4 is used in the same manner as the above-described embodiment. The coils attached to the contacts 30 serve no useful purpose, and if desired, can be removed and discarded.

Another embodiment of a cleaning implement according to the present invention is illustrated in FIG. 5. The cleaning implement 332 of FIG. 5 includes a support element 334 which may be made of metal or plastic and is preferably in the form of a generally rectangular, flat sheet of material. A pair of mounting tabs 350 and 352 are bent down from the main portion of the support sheet 334 at each end thereof. One or both of the tabs 350 and 352 may have a central cut-out 354 so as to form a pair of spaced mounting fingers 356. Tabs 350 and 352 serve to attach the cleaning implement 332 over one of the channel selector strips 26 whereupon the tuner spring-contacts may be cleaned without removing even a single channel selector strip. The cut-out 354 is provided to accommodate existing tuner structures, such as fine tuning slugs which may exist at the end of the channel selector strip 26 adjacent end wall 22 of the drum.

Support element 334 of the implement of FIG. 5 may be flat or may be curved so as to fit over contacts 30 of the channel selector strip 26 with the lateral edges of the support element 334 flush with the top surface of the strip 26. The top or outer surface of the support 334 is provided with a layer or coating of abrasive material 340. This coating of abrasive material may be painted, sprayed or otherwise applied to the support element 334 or may be carried on a separate backing which is attached to the support. For example, a fine grade of emery cloth or sandpaper may be adhesively fixed to support 334, if desired.

In operation, the cleaning implement of FIG. 5 is designed to be snapped in place over any of the channel selector strips 26 of the tuner drum. Rotation of the drum shaft 20 will then cause the abrasive layer 340 to engage and clean the fixed, spring-contacts 16, after which the cleaning implement may be snapped off the drum and retained for reuse. Since there are a number of drum-type tuners in use, each having a slightly different structural configuration, modifications and changes in the mounting tab structure may be necessary, and the present invention contemplates the use of any appropriate attachment arrangement whereby the cleaning implement may be temporarily attached overlying a channel selector strip and, after the cleaning operation is complete, removed for subsequent use.

A still further embodiment of the present invention is illustrated in FIG. 6 in which the cleaning implement consists of a cut length of strip material which may be provided in a roll or in any other convenient form. The cleaning implement, identified as 432, consists of an abrasive layer 440 supported on a paper substrate 434. The substrate 434 does not necessarily have to be paper, but may be cloth or any other desired material which may be easily cut to the desired length. Abrasive layer 440 and substrate 434 may consist of a thin strip of sandpaper, emery paper, or emery cloth. On the bottom side of the paper substrate 434, opposite the abrasive layer 440, is an adhesive layer 450. Preferably, the adhesive is a rubber cement which is provided with a protective sheet 452 which may be peeled off of the adhesive layer just prior to use.

The cleaning implement 432 of the embodiment of FIG. 6 may be used by first placing the strip alongside the channel selector strips of the tuner to be cleaned and noting the approximate length of the strips. The cleaning implement is then cut to the necessary length and the protective sheet 452 is peeled from the back of the cut strip. The strip is then adhesively attached over one of the channel strips 26, and the tuner shaft 20 is rotated to cause the abrasive 440 to engage and clean the spring-contacts 16. After the cleaning operation is completed, the cleaning implement can be peeled off of the channel selecting strip and discarded. It can be appreciated that the cleaning implement of FIG. 6 can readily accommodate variations in tuner designs from one model to another since any desired length can be cut from the roll.

From the foregoing, it can be appreciated that the present invention provides a simple, effective and efficient cleaning implement and method for removing dirt and contamination from the fixed, spring-contacts of a television tuner or any other drum-type electrical switching arrangement. According to the present invention, the spring-contacts can be completely cleaned without major disassembly of the tuner and without causing any damage to the tuner components even where the spring-contacts are inaccessible.

Inasmuch as the present invention is subject to many variations, modifications, and changes in detail, it is intended that all matter contained in the foregoing description or shown in the accompanying drawing shall be interpreted as illustrative and not in a limiting sense.

What is claimed is:

1. A cleaning implement for cleaning fixed spring-contacts of a cylindrical, drum-type tuner having replaceable contact-carrying strips arranged about the circumference of a rotatable drum, comprising:

a support element in the form of a substantially rectangular sheet of material;

means on said support element for removably attaching said element to the drum over a contact-carrying strip of the tuner; and cleaning means in the form of a layer of abrasive material on said support sheet for engaging and cleaning the fixed spring-contacts of the tuner upon rotation of said drum;

said attaching means including tabs on said sheet at each end thereof for snap-on engagement with opposite ends of the tuner drum whereby said support element can be snapped over a contact-carrying strip for cleaning.

2. A cleaning implement as recited in claim 1 wherein said sheet is metal and said tabs are bent from the ends of said sheet.

3. A cleaning implement for use in cleaning fixed spring-contacts of a cylindrical, drum-type tuner having replaceable contact-carrying strips arranged about the circumference of a rotatable drum, comprising:

a support element;

means on said support element for attaching said element to the drum; and cleaning means on said support element for engaging and cleaning the fixed spring-contacts of the tuner upon rotation of said drum, wherein said support element comprises a contact-carrying strip, and wherein said cleaning means comprises a coating of a rapid drying liquid which contains abrasive particles suspended in a hardenable binder on the contacts of said contact-carrying strip.

4. A method of cleaning fixed spring-contacts of a cylindrical, drum-type tuner having replaceable contact-carrying strips arranged about the circumference of a rotatable drum, comprising the steps of:

coating the contacts of a contact-carrying strip with a rapid drying liquid which contains abrasive particles suspended in a hardenable binder;

temporarily substituting said coated strip for an operative strip on the drum;

rotating the drum to bring said coated strip into engagement with the spring-contacts of the tuner so as to clean the fixed contacts; and removing said coated strip from the drum.

* * * * *